US007145541B2

(12) United States Patent
Kurokawa et al.

(10) Patent No.: US 7,145,541 B2
(45) Date of Patent: Dec. 5, 2006

(54) DISPLAY DRIVER CONTROL CIRCUIT AND ELECTRONIC EQUIPMENT WITH DISPLAY DEVICE

(75) Inventors: Yasuhito Kurokawa, Higashimurauyama (JP); Shigeru Ohta, Higashimurayama (JP); Kunihiko Tani, Kodaira (JP); Goro Sakamaki, Fuchu (JP); Yoshikazu Yokota, Kodaira (JP)

(73) Assignee: Renesas Technology Corp., Tokyo (JP)

( * ) Notice: Subject to any disclaimer, the term of this patent is extended or adjusted under 35 U.S.C. 154(b) by 435 days.

(21) Appl. No.: 10/372,911

(22) Filed: Feb. 26, 2003

(65) Prior Publication Data

US 2003/0169244 A1 Sep. 11, 2003

(30) Foreign Application Priority Data

Mar. 6, 2002 (JP) ..... 2002-060340
Feb. 6, 2003 (JP) ..... 2003-029376

(51) Int. Cl.
*G09G 3/36* (2006.01)

(52) U.S. Cl. ..... 345/98; 345/99; 345/204

(58) Field of Classification Search ..... 345/98–100, 345/204, 87

See application file for complete search history.

(56) References Cited

U.S. PATENT DOCUMENTS 6,529,249 B1 * 3/2003 Hashemi
6,930,675 B1 * 8/2005 Ishiyama ..... 345/204

FOREIGN PATENT DOCUMENTS

JP 9-281933 * 10/1997

* cited by examiner

*Primary Examiner*—Regina Liang
(74) *Attorney, Agent, or Firm*—Miles & Stockbridge, PC

(57) ABSTRACT

There is provided a display driver control circuit which is just suitable for display drive including display with a small amount of change and display with a large amount of change and can realize saving of chip area and reduction of power consumption and cost. In this display driver control circuit, memory capacity of an internal display memory is set smaller than amount of data of one display picture of a display panel as the drive object, and the display data can be transferred with the system in which externally inputted display data is once stored in the display memory and is then sent of a drive circuit to output a drive signal and with the system in which the display data is sent in direct to the drive circuit by way of no display memory to output a drive signal. Moreover, both transfer methods can be executed on the time division basis.

7 Claims, 10 Drawing Sheets

FIG. 2(a) DISPLAY AREA AND DISPLAY RAM CAPACITY
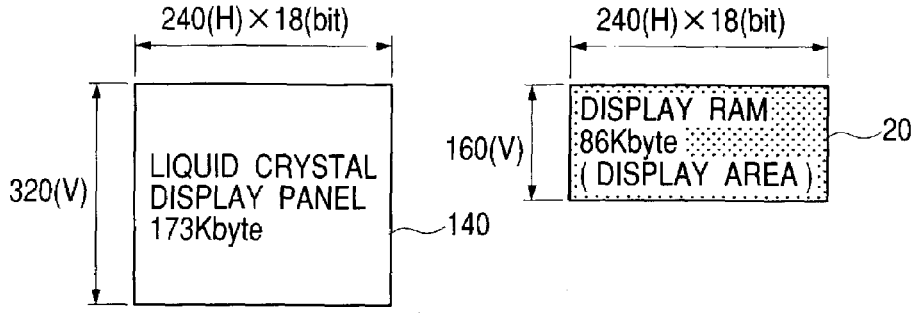
FIG. 2(b) MAPPING AREA OF RAM
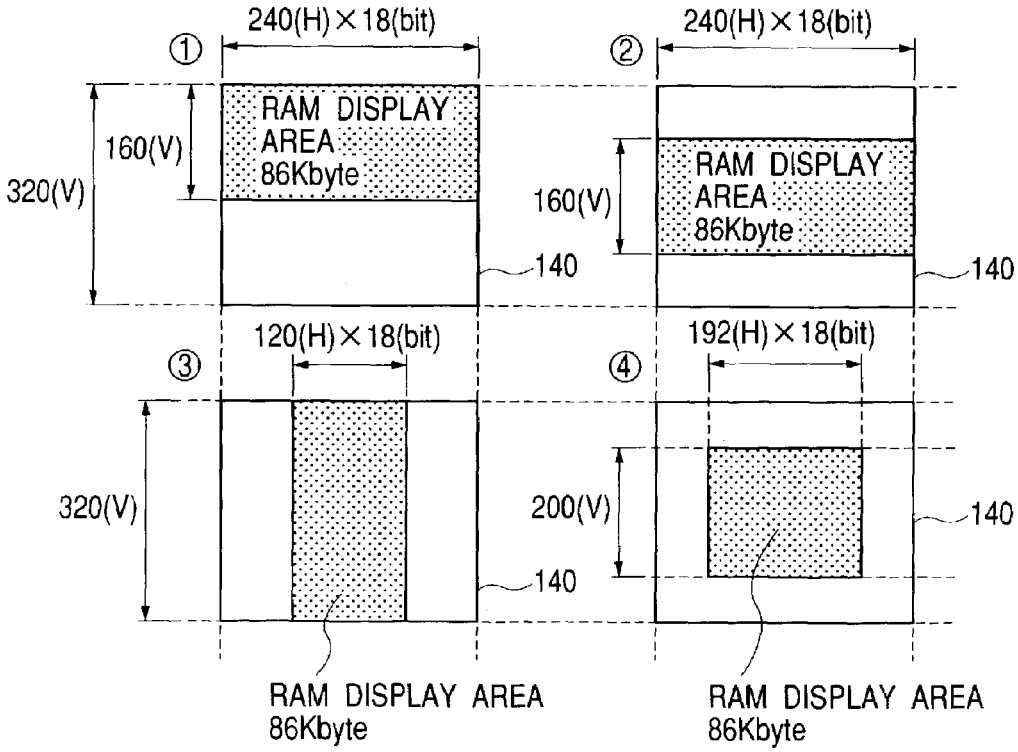
FIG. 3
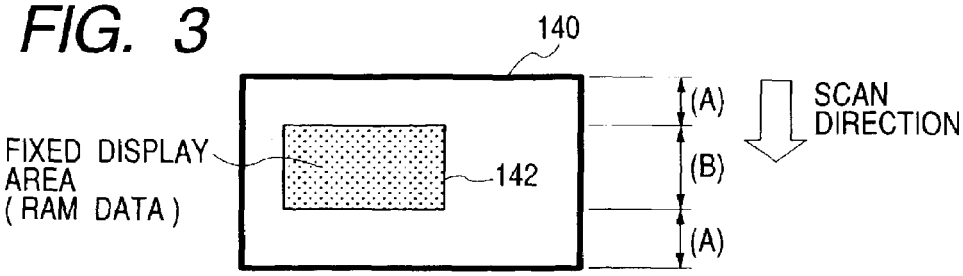

FIG. 8(a) DISPLAY AREA AND DISPLAY RAM CAPACITY
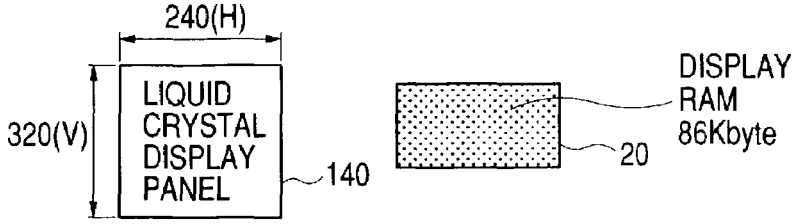
FIG. 8(b)
RELATIONSHIP BETWEEN DISPLAY AREA AND DATA IN DISPLAY RAM
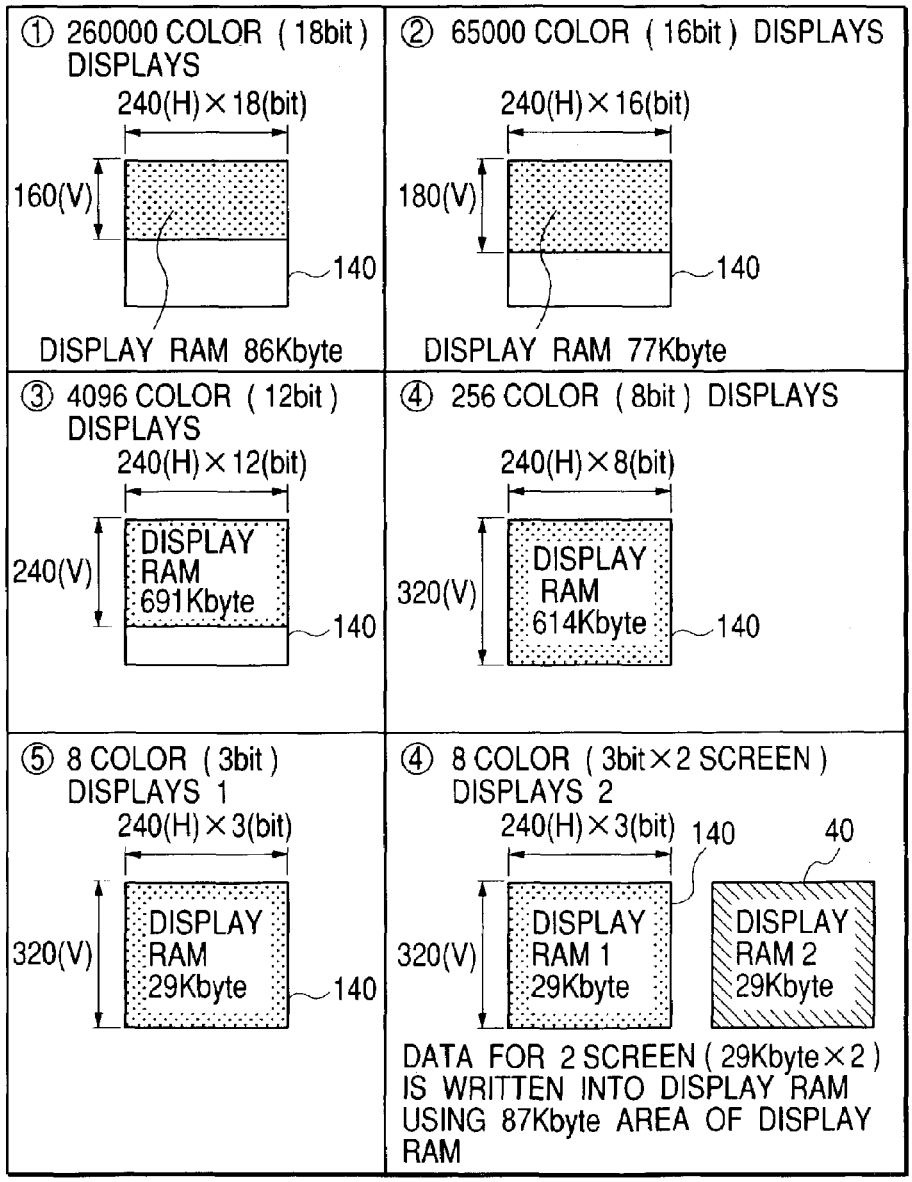

DISPLAY DRIVER CONTROL CIRCUIT AND ELECTRONIC EQUIPMENT WITH DISPLAY DEVICE

BACKGROUND OF THE INVENTION

The present invention relates to technique which can be effectively applied to a display driver control circuit for driving a display device such as a liquid crystal display panel and particularly to technique which can be effectively applied to a display driver control circuit of a display panel of a small size information terminal, for example, a mobile phone In these years, a dot matrix type liquid crystal display panel where a plurality of display pixels are allocated in two dimensions in the shape of matrix is generally used as a display device of mobile electronic devices such as mobile phones and PDA (Personal Digital Assistants). In this display device, a liquid crystal display control circuit (liquid crystal controller) formed on a semiconductor integrated circuit for display control of the liquid crystal display panel and a driver for driving the liquid crystal display panel or a liquid crystal display driver control circuit (liquid crystal controller driver IC) comprising the driver are mounted.

The liquid crystal controller driver IC for driving the liquid crystal display panel provided in such mobile electronic devices is required to have small chip area and lower power consumption from the property of mounting into mobile terminals. The liquid crystal controller driver used in the system including a small-size liquid display panel such as mobile phones generally is configured to comprise a display memory having the capacity larger than the amount of display data of one display area of the display panel and to read the display data for every one horizontal line after once storing this data in the display memory in order to convert the data to gradation voltage and to output to the display panel.

A liquid crystal controller driver comprising a display memory is disclosed in the invention, for example, as the patent reference 1 (Japanese Laid-Open Patent Publication No. Hei 9(1997)-281933).

SUMMARY OF THE INVENTION

However, in these years, a mobile phone is in the tendency that the display area size of display panel and the number of display colors are more and more increasing. Therefore, when a liquid crystal controller driver is used for a liquid crystal panel in the present configuration, the display memory used therein is required to have extremely large capacity. Accordingly, chip area and power consumption of the liquid crystal controller drive also increases remarkably, resulting in considerable rise of fabrication cost.

Moreover, since a liquid crystal panel provided in a mobile information terminal such as PDA (Personal Digital Assistants) has a display area size which is larger than the liquid crystal panel of mobile phone, it has been difficult to introduce the display memory having larger capacity enough for storing of display picture data of one display area into the liquid crystal controller driver. For this reason, a system has been generally employed, in which picture data is once stored in an external memory called an external fame buffer and a microprocessor reads the picture data from the frame buffer as required and then transfers this picture data to the liquid crystal controller driver.

It is therefore an object of the present invention to provide a display driver control circuit which can adequately drive a display panel of comparatively large display size and of larger number of display colors and can realize saving of chip area and reduction of power consumption and fabrication cost.

Another object of the present invention is to provide a display driver control circuit which can effectively realize reduction in size of an electronic device using a display panel of comparatively larger size such as PDA.

The typical inventions disclosed in the present invention will be described as follows.

According to one aspect of the present invention, capacity of internal display memory is set smaller than the amount of data of one display area of display panel as the driving object, both systems that externally inputted display data is once stored in the display memory and is then transferred to the output drive side for output of a drive signal and that such display data is transferred in direct to the output driver side by way of no display memory for output of the drive signal are possible as the way of transferring the display data and moreover these two systems are realized on the time division basis.

According to this means, this display memory can be selectively and adequately used considering contents of display data, for example, by using the display memory for display of picture data including a small amount of changes and transferring the display data by way of no display memory for display of picture data including a large amount of changes such as moving picture. As a result, it is no longer required to increase capacity of the display memory more than that required and chip size of the liquid crystal controller driver IC comprising such display memory can also be reduced.

According to another aspect of the present invention, a gradation voltage generator is provided to realize display drive depending on the number of bits even when the number of bits of data of one pixel is different and moreover a display data bits converter or the like is also provided. Accordingly, the display data of one display area can be stored to an internal display memory which cannot store the display data of one display area for the full-color display even when the number of display colors is also reduced because the number of bits of data of one pixel is reduced. In addition, in this case, operation of an amplifier for unwanted voltage among the buffer amplifiers forming the gradation voltage generator is stopped. Thereby, power consumption can be reduced.

The above-mentioned and the other objects and novel features of the present invention will become apparent from the description of this specification and accompanying drawings of the present invention.

BRIEF DESCRIPTION OF THE DRAWINGS

FIGS. 2A to 2B are diagrams for describing relationship between capacity of a display memory of the liquid crystal controller driver and display area of a liquid crystal display panel.

FIG. 3 is a diagram illustrating a display example where fixed display based on data of the display memory and direct write display by way of no display memory are mixed.

FIGS. 8A to 8B are diagrams illustrating practical application examples of the display memory when the number of gradation voltages of one pixel is changed.

DETAILED DESCRIPTION OF THE PREFERRED EMBODIMENT

The preferred embodiment of the present invention will be described with reference to the accompanying drawings.

Figure 1:
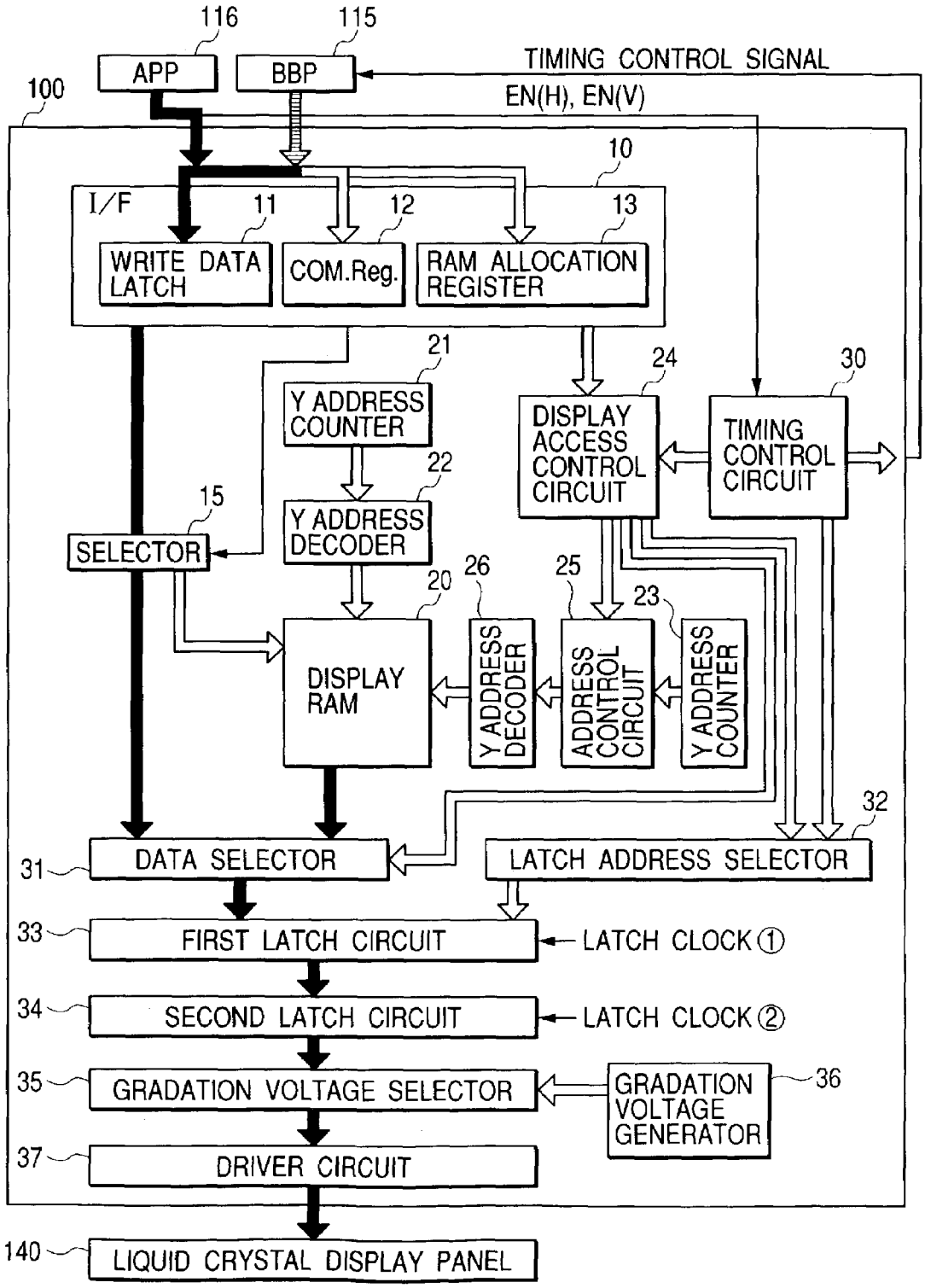
FIG. 1 is a block diagram illustrating a schematic configuration of a liquid crystal controller driver as an embodiment of the present invention.

FIG. 1 is a block diagram illustrating a schematic configuration of a liquid crystal controller driver as an embodiment of a display driver control circuit of the present invention.

The liquid crystal controller driver 100 of this embodiment is formed, although not particularly restricted, on a semiconductor chip like a single crystalline silicon with the well-known semiconductor fabrication technology.

In FIG. 1, numeral 10 designates an input interface which is connected to devices such as a baseband processor 115 and an application processor 116 at the outside of chip for transmission and reception of signals. A numeral 20 designates a display RAM consisting of an SRAM for storing display data.

The input interface 10 comprises a write data latch circuit 11 for latching display data inputted from the baseband processor 115 and application processor 116, a command register 12 to which various commands and code indicating the transferring address (destination) of display data are set, and an allocation register 13 to which display position on the display area based on display data of the display RAM is set.

Numeral 15 designates a selector as a selection means for selecting a write address (destination) of display data; 21, an X address counter for generating a data write address in the horizontal direction of the display RAM 20 in which display data is stored; 22, an X-address decoder for decoding the generated X-address; 23, a Y-address counter for generating a data write address in the vertical direction of the display RAM 20; 24, a display access control circuit for controlling data read timing of the display RAM 20 based on setting value of the allocation register 13; 25, an address control circuit for shifting and reducing an address value from the Y-address counter 23 under the control of the display access control circuit; and 26, a Y-address decoder for decoding the Y-address. A display position control means is configured with the display access control circuit 24 and address control circuit 25.

Moreover, numeral 30 designates a timing control circuit for synchronizing input timing of display data from the baseband processor 115 and output timing of display data from the display RAM 20; 31, a data selector for selecting any one data of the display data read from the display RAM 20 or the display data transferred in direct from the input interface 10; 32, a latch address selector for selecting the address of latch circuit 33 to which the data selected by the data selector 31 is latched; 33 and 34, a first latch circuit and a second latch circuit to which the display data of one horizontal line of the liquid crystal display panel 140 is held; 36, a gradation voltage generator for generating a gradation voltage selected depending on the display data; 35, a gradation voltage selector for selecting a gradation voltage corresponding the latched display data; and 37, a driver circuit as an output driver for driving a vertical electrode (called a source line or data line in the case of a TFT liquid crystal display panel) of the liquid crystal display panel 140. A data supplying means is configured with the data selector 31 and latch address selector 32 among these circuits.

A picture data is displayed by repeating the processes that the liquid crystal controller driver 100 of this embodiment sequentially generates and outputs, for every horizontal line, a data line drive signal of the liquid crystal display panel 140 based on the display data inputted from an external device or the display data read from the display RAM 20 and that a common driver (called a gate driver in the case of the TFT liquid crystal display panel) not illustrated sequentially selects, in synchronization with such liquid crystal controller driver 100, the common lines (gate lines), for example, to the lower end from the upper end. The common driver may be formed on the chip where the liquid crystal controller driver 100 is also formed or may also be configured as another semiconductor integrated circuit.

In the liquid crystal controller driver 100 of this embodiment, display data used to drive the liquid crystal display panel 140 is transferred from the baseband processor 115, but this liquid crystal controller driver 100 may also be configured to enable operation to read this display data to the latch circuit 33 after the display data is once stored in the display RAM 20 and operation to transfer in direct the display data to the latch circuit 33 from the input interface 10 by way of no display RAM 20.

Selection for writing display data to the display RAM 20 or supplying display data to the latch circuit 33 is made when the selector 15 is switched depending on a setting value of the command register 12. Moreover, setting of the command register 12 can be done with the baseband processor 115. Display data of still picture is written to the display RAM 20 with the baseband processor 115, while display data of moving picture which requires high speed data transfer is transferred to the latch circuit 33 with the application processor 116.

FIGS. 2A to 2B are diagrams for describing relationship between capacity of a display memory of the liquid crystal controller driver and display area of a liquid crystal display panel.

The display RAM 20 is configured, for example, to have the data capacity which is enough for storing the data equal to a half of the data of one display area but is less than the amount of display data of one display area of the liquid crystal display panel 140, namely the value of (total number of pixels×number of bits per pixel). Therefore, the display area corresponding to each address of the display RAM 20 is defined, as illustrated in FIG. 3, as a partial area (hereinafter, referred to as fixed display area) 142 of the display area of the liquid crystal display panel 140.

However, the display area 142 corresponding to each display RAM 20 is never fixed and may be allocated in various manners depending on a setting value of the allocation register 13. A shape of the display area corresponding to the display RAM 20 may be varied, as illustrated in FIG. 2B, such as to rectangular shape, horizontally elongated rectangular shape and vertically elongated rectangular shape. Moreover, the shape of display area can also be set to various areas such as one integrated area and area divided into a plurality of sub-areas by making it possible to set a plurality of addresses to the allocation register 13.

This corresponding relationship may be realized with the control in the Y address direction such as read of Y address data of the display RAM 20 aligned with the read timing of the display data of the horizontal line of the liquid crystal display panel 140, based on the setting value of the allocation register 13, and the control in the X address direction that to which position of the latch circuit 33, the display data read from the display RAM 20 should be stored. The former control may be realized with the display access control circuit 24, latch address selector 32 and data selector 31.

In this embodiment, display based on display data of the display RAM 20 (hereinafter, referred to as fixed display) and direct write display by way of no display RAM 20 can be performed simultaneously. This function enables display of picture data transferred through direct writing of data to the peripheral area of the fixed display area 142 of FIG. 3.

Next, operation when the fixed display and direct write display are performed simultaneously will be described with reference to FIGS. 4A, 4B, 4C, 4D to FIG. 6. The fixed display in the present specification does not mean the display which is always fixed but the display based on display data of the display RAM 20.

FIGS. 4A to 4D are diagrams illustrating display operations when direct write display exists in a part of the fixed display area 142. The fixed display area 142 for the display based on display data of the display RAM 20 can be expanded to the entire part of the liquid crystal display panel 140 when the number of bits forming one pixel is reduced as will be described later. In FIGS. 4A to 4D, the fixed display area 142 forms the entire part of the liquid crystal display panel 140. The number of bits to form one pixel can be designated by providing a bit number designation register in the control register 12 or a bit number designation field in the vacant field of the register and then previously providing such register with the baseband processor 115 or the like.

Figure 4A:
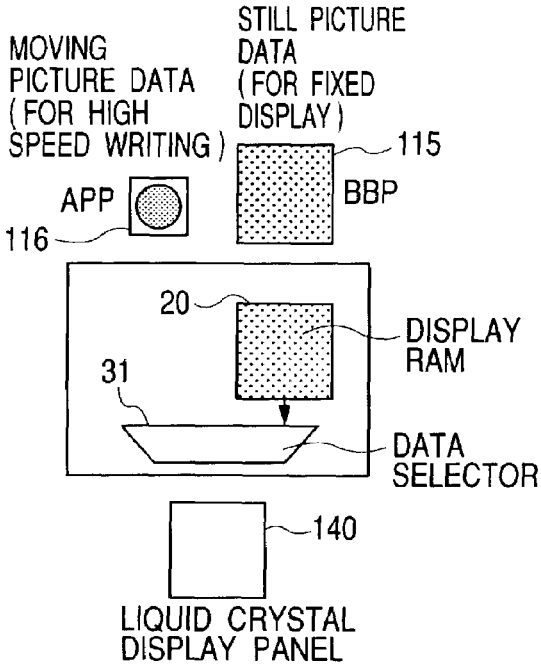
FIGS. 4A to 4D are diagrams illustrating display operations where the fixed display based on the display memory and direct write display by way of no display memory are mixed.
Figure 4B:
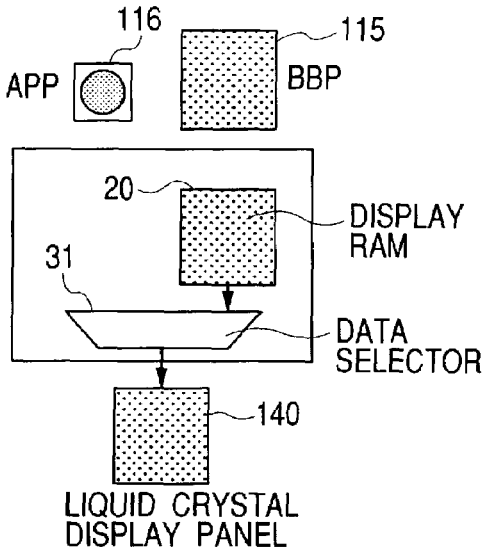
Figure 4C:
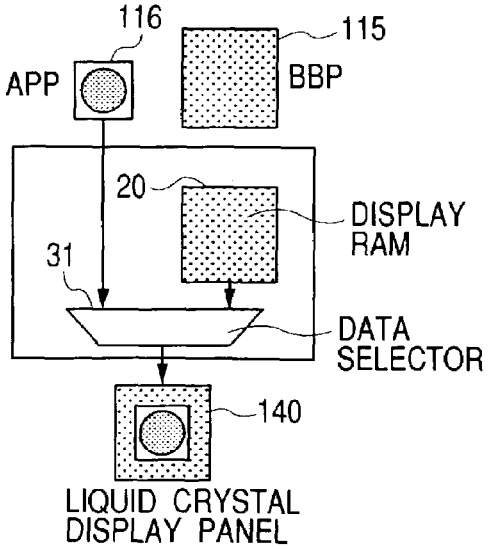
Figure 4D:
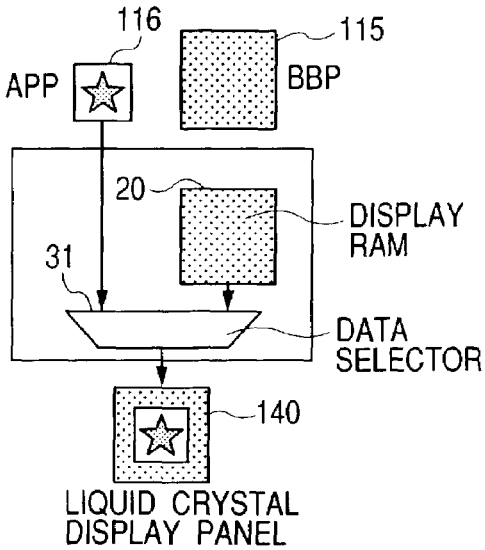

In FIGS. 4A and 4B, still picture data is written to the display RAM 20 in the driver from the baseband processor 115 and such data is read from the display RAM 20 and then displayed on the liquid crystal display panel 140. In FIGS. 4C and 4D, any one of the direct write data (moving picture data) transferred from the application processor 116 and the picture data already written into the display RAM 20 is selected with the selector 31 and is then displayed on the liquid crystal display panel 140.

For the display operation described above, following controls are performed. Namely, an enable signal EN (H) indicating the effective period of display in the horizontal direction (line direction) and an enable signal EN (V) indicating the effective period of display in the vertical direction are outputted to the timing control circuit 30 from the application processor 116, the timing control circuit 30 switches the data selector 31 to the side of selector 15 via the display access control circuit 24 only when these enable signals EN indicate the effective level (high level) and outputs a control signal which allows extraction of data by the latch circuit 33 to the latch address selector 32, and the latch circuit 33 latches the direct display data sent from the application processor 116 only during the period permitted or latches the display data read from the display RAM 20 in other periods.

Figure 5:
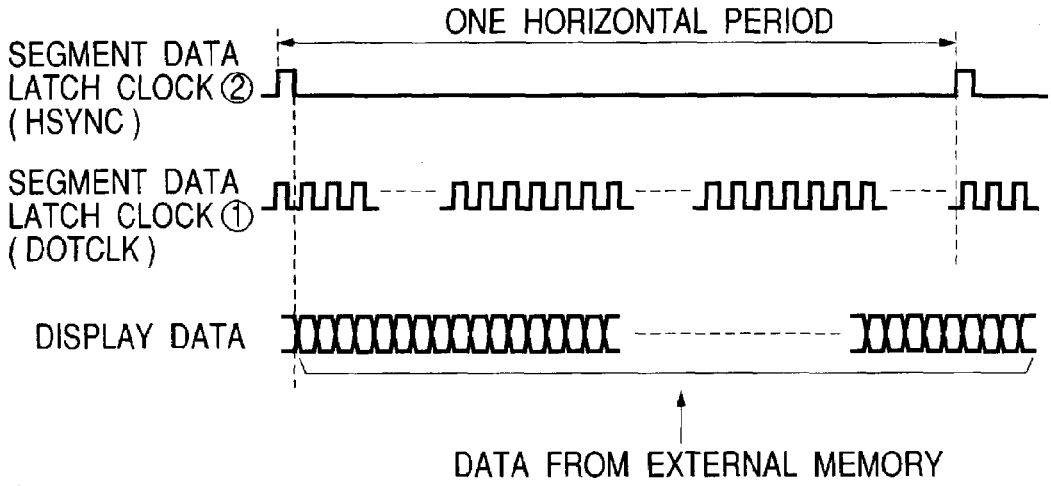
FIG. 5 is a time chart for describing transfer operation of display data in the horizontal period (A) of FIG. 3.
Figure 6:
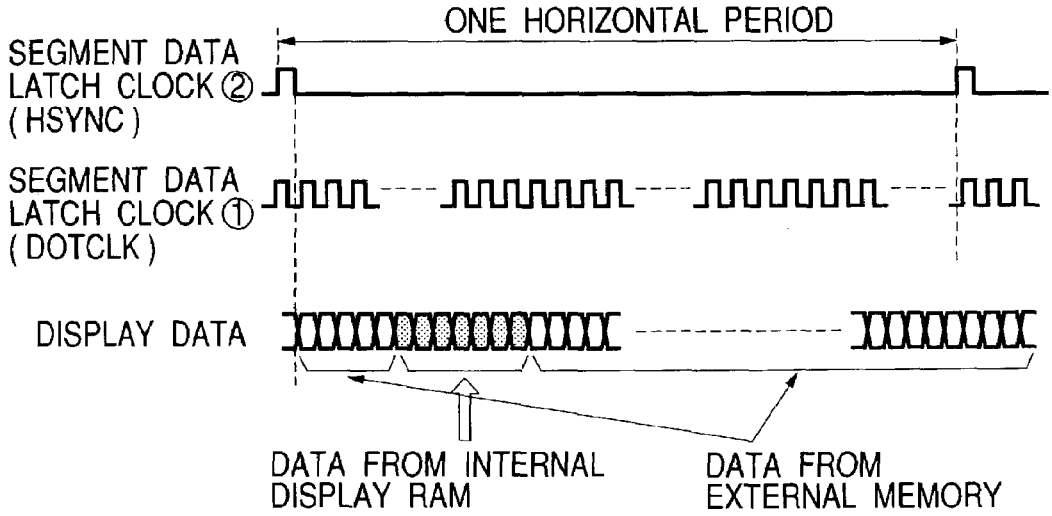
FIG. 6 is a time chart for describing transfer operation of display data in the horizontal period (B) of FIG. 3.

On the other hand, in FIG. 5 and FIG. 6, a display data transfer timing when the direct write display exists in the external side of the fixed display area 142 is shown as illustrated in FIG. 3. FIG. 5 is the time chart indicating the latch operation of display data to the latch circuits 33, 34 only for the direct write display in the range of FIG. 3A, while FIG. 6 is the time chart indicating the latch operation display data to the latch circuits 33, 34 for both fixed display and direct write display in the range of FIG. 3B. In these FIG. 5 and FIG. 6, the latch clock (1) is the clock signal synchronized with dot clock DOTCLK supplied from the external side and the latch clock (2) is the clock signal synchronized with horizontal synchronization signal HSYNC supplied from the external side.

As illustrated in FIG. 5, when the direct write display is performed, the display data of one line of display panel is sequentially supplied to the first latch circuit 33 during one horizontal period in synchronization with the latch clock (1), while the display data of one horizontal line stored in the first latch circuit 33 is transferred, in every horizontal period, at a time to the second latch circuit 34 in synchronization with one latch clock(2). The display data latched by the second latch circuit 34 is transferred to the driver circuit 37 to generate and output a segment drive signal. The latch clocks (1) and (2) are supplied from the timing control circuit 30.

For the direct write display as illustrated in FIG. 5, the data selector 31 is switched to select display data from the external side so that the selector 15 transfers the display data supplied from the external side to the selector 31 based on the setting value of the control register 12 and thereby the display data is sequentially written into the latch circuit 33 via the selectors 15 and 31.

on the other hand, during the period where the direct write display and fixed display are performed simultaneously as illustrated in FIG. 6, display data is transferred from the external side and written into the latch circuit 33 in synchronization with the display timing as in the case of FIG. 5 and a selection path of the data selector 31 is switched under the control of the display access control circuit 24 at the fixed display position on one horizontal line set in the allocation register 13 for the latch of display data in the internal RAM 20 to the address corresponding to the fixed display position of latch circuit 33.

Display data can also be written into the internal RAM 20 during the period where the direct write display is not performed or within the vertical retrace line period even during the period where the direct write display is performed.

As described above, according to the liquid crystal controller driver 100 of this embodiment, since the for simultaneous displays of the fixed display based on display data of the display RAM 20 and the direct write display by way of no display RAM 20 is possible, even when amount of display data of display picture size, namely one display picture of the liquid crystal display panel 140 increases, capacity of the display RAM 20 can be reduced adequately.

FIGS. 8A and 8B illustrate the other examples of the correspondence between display data in the display RAM 20 and display picture of the liquid display panel in the liquid crystal controller driver 100 of this embodiment.

Figure 7:
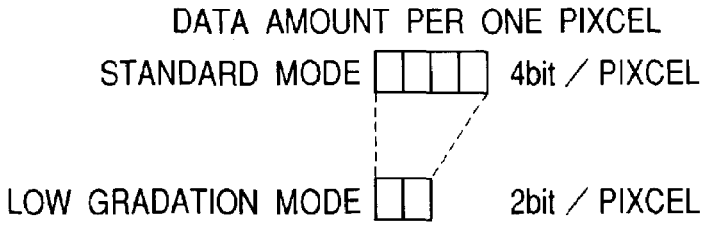
FIG. 7 is a diagram for describing application examples of the display memory and others.

Correspondence between the display RAM 20 and display picture may be realized not only by partial correspondence of display picture as illustrated in FIGS. 2A and 2B but also by correspondence between display data of the display RAM 20 and all pixels of liquid display panel through reduction in the number of gradation voltages of one pixel of the liquid crystal display panel 140. For example, as illustrated in FIG. 7, the liquid crystal display panel 140 is capable of displaying data in the 16(4-bit) gradation voltages per pixel. When this 16-gradation display is defined as the standard mode, correspondence between the display data stored in the display RAM 30 and all pixels of the liquid crystal display panel 140 can be set by switching the standard mode to the low gradation mode, which is provided to perform display in the 4(2-bit) gradation per pixel, even when the capacity of display RAM 20 is about a half of the amount of display data of one display picture in the standard mode.

However, when such low gradation mode is provided, it is required to form the configuration that the read data of 4-bit is divided to upper 2-bit and lower 2-bit on the occasion of writing the display data read from the display RAM 20 to the latch circuit 33, the write operation of 4-bit data is switched to the write operation of 2-bit data by respectively writing these 2-bit data, for example, to the upper 2-bit of the two 4-bit latches provided adjacently where each lower 2-bit is masked.

In FIG. 7, one pixel is formed of 4 bits in standard. However, in the liquid crystal controller driver in this embodiment which can drive a liquid crystal display panel to realize gradation display based on the display data in which one pixel is formed of 18 bits, relationship between the display area of the display panel 140 and display data in the display RAM 20 can be changed, for example, as (1) to (5) of FIG. 8B by changing the number of bits of data per pixel of the display RAM 20.

FIG. 8B(1) corresponds to the standard mode where a pixel is formed of 18 bits, FIG. 8B(2), to the semi-high gradation mode where a pixel is formed of 16 bits, FIG. 8B(3), to the intermediate gradation mode where a pixel is formed of 12 bits; FIG. 8B(4), to the intermediate gradation mode where a pixel is formed of 8 bits; FIG. 8B(5), to the low gradation mode where a pixel is formed of 3 bits. As illustrated in FIG. 8B(6), the picture data of two pictures can be stored in the display RAM 20 by selecting the low gradation mode of FIG. 8B(5). From FIGS. 8A to 8B, it can be understood that the corresponding display area can be expanded as the number of colors of one pixel is reduced.

Figure 9:
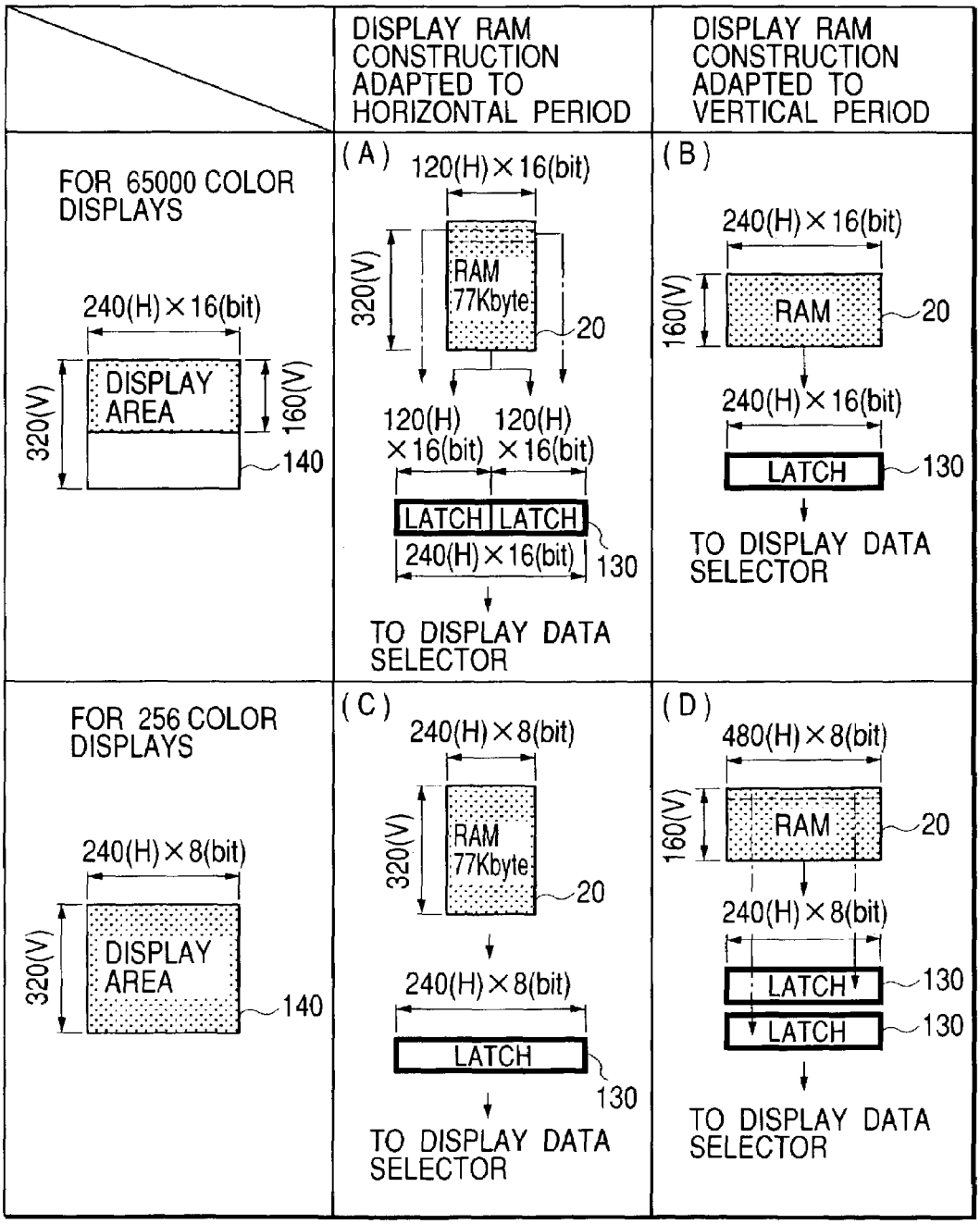
FIG. 9 is a diagram for describing respective examples when array configuration of the display memory and the number of gradation voltages of pixels are changed for a transfer system of display data to a first latch circuit from the display memory.

FIG. 9 illustrates a method of forming a configuration of the display RAM 20 having the capacity to store the data which is equal to a half of display data of one display picture of the liquid crystal panel in the case of full-color display, a method of reading data to the latch circuit 130 (within the display RAM 20 in FIG. 1) from the display RAM 20 and a method of reading data to the latch circuit 130 in the case where the number of bits of picture data per pixel is changed.

In FIG. 9, the RAM configuration aligned for the vertical period means that the number of lines of memory of the display RAM 20 to store the data to be displayed on the liquid crystal display panel is set to 320 depending on the number of pixels in the vertical direction of the same liquid crystal display panel which enables color displays, for example, of 16 bits per pixel with the 320 dots as the number of pixels in the vertical direction and with 240 dots as the number of pixels in the horizontal direction, namely of color displays in about 65000 colors. Moreover, the RAM configuration aligned for the horizontal period means that the number of lines of memory of the display RAM 20 to store the data to be displayed on the liquid crystal display panel of 320×240 dots in both horizontal and vertical directions is set to 240 depending on the number of pixels in the horizontal direction of the liquid crystal display panel.

Meanwhile, the latch circuit 130 to hold the data read from the display RAM 20 is assumed to have the capacity of 240×16 bits which can store the picture data of all pixels in the horizontal direction of the liquid crystal display panel in any cases. In this case, in the RAM configuration aligned to the vertical period, the display data as many as those of 120 pixels of the odd number lines of FIG. 9A read from the display RAM 20 are stored to a half side area of the latch circuit 130, while the display data as many as those of 120 pixels are stored to a remaining half side area of the latch circuit. When the data of 240 pixels are stored completely, this data is outputted to the data selector 31.

Moreover, in the RAM configuration aligned to the horizontal period, the display data read from the display RAM 20 is once stored, in every line (240 pixels), in the latch circuit 130 as illustrated in FIG. 9B and thereafter this display data is outputted to the data selector 31.

In the case where the liquid crystal display panel which enables color display of 256 colors (8-bit gradation) in the 320×240 dots in both vertical and horizontal directions is driven with the liquid crystal controller driver which can drive the liquid crystal display panel which enables color display of 65000 colors in the 320×240 dots in both vertical and horizontal direction as described above, the display data of 240 pixels×8 bits (however, in unit of 16 bits in the data written from externally) of one line of the liquid crystal display panel is stored to each line of the display RAM 20 in the RAM configuration aligned to the vertical period. Therefore, in this case, the display data is read for line by line from the display RAM 20 as illustrated in FIG. 9C and this data is once stored in the latch circuit and then outputted to the data selector 31.

In the RAM configuration, moreover, aligned to the horizontal period, the display data of 480 pixels×8 bits of two lines of the liquid crystal display panel is stored to each line of the display RAM 20. Therefore, in this case, a half (240 pixels) of the display data of one line read from the display RAM 20 is stored to the first latch circuit as illustrated in FIG. 9D and thereafter this data is transferred to the second latch. Thereby, a remaining half data is read to the first latch circuit and then this data is sequentially outputted to the data selector 31.

As described above, the optimum layout for minimizing chip cost can be selected by determining the configuration of the display RAM 20 and bit length of the latch circuit depending on the size of liquid crystal display panel and the number of bits per pixel required for display of gradation.

Next, a configuration example of the gradation voltage generator 36 in the liquid crystal controller driver in this embodiment is described with reference to FIG. 13.

Figure 13:
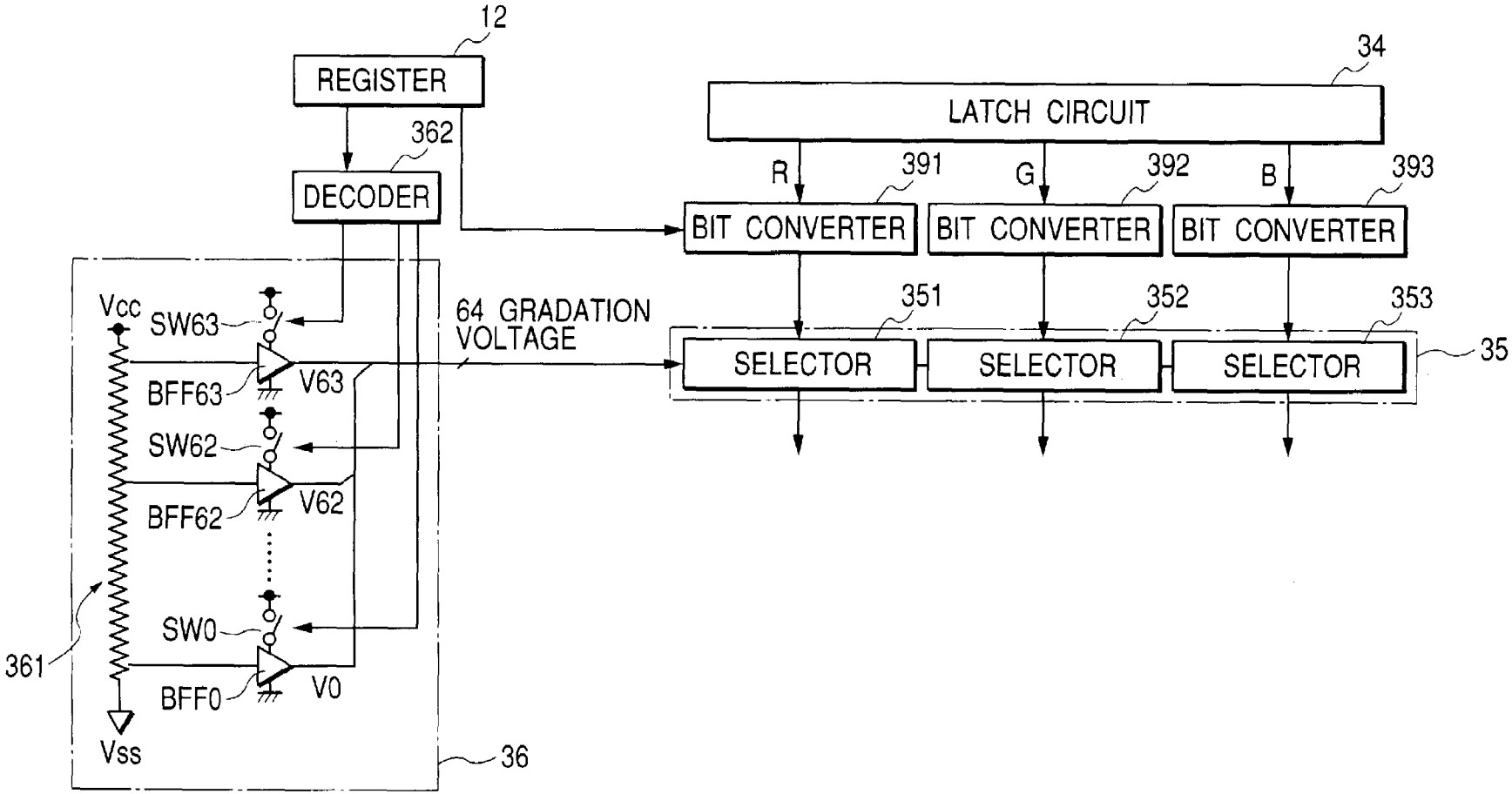
FIG. 13 is a block diagram illustrating a configuration example of the gradation voltage generator.

The gradation voltage generator 36 in this embodiment is composed, for example, of a ladder resistor 361 connected between the power source voltage terminals Vcc-Vss and a plurality of buffer amplifiers BFF0 to BFF63 which output the desired voltage divided with the ladder resistor 361 through the impedance conversion as illustrated in FIG. 13. This gradation voltage generator 36 is configured to generate and output the gradation voltages V63 to V0 in 64 steps in maximum. In the ladder resistor 361, a resistance ratio is set to generate the gradation voltages of V63 to V0 for compensation of γ characteristic of the liquid crystal display panel used or the node connected to the input terminals of the buffer amplifiers BFF0 to BFF63 is determined to extract the gradation voltages required for compensation of the γ characteristic.

Moreover, the gradation voltage generator 36 of this embodiment is configured to comprise a decoder 362 for decoding the number of pixel bits set in the bit number designation register within the control register 12 and power supply switches SW0 to SW63 provided in the buffer amplifiers BFF0 to BFF63 in order to switch the buffer amplifiers among the buffer amplifiers BFF0 to BFF63 to be validated with an output of the decoder 362 depending on the number of designated pixel bits. Namely, for example, when the designated number of pixel bits is 6 bits, all buffer amplifiers are activated, when the designated number of pixel bits changes to 5 bits from 6 bits, a half (32 amplifiers) of the 64 buffer amplifiers BFF0 to BFF63 is invalidated (OFF), and when the designated number of pixel bits changes to 4 bits, 48 amplifiers (3/4) of the 64 buffer amplifiers BFF0 to BFF63 can be invalidated (OFF). Therefore, power consumption of the gradation voltage generator 36 can be reduced remarkably.

In addition, the gradation voltage generator 36 can also be configured to reduce the number of output voltages by validating, when the number of pixel bits is reduced to 5 bits, the buffer amplifiers BFF0 to BFF63 in every another buffer amplifier or by validating, when the number of pixel bits is reduced to 4 bits, the buffer amplifiers BFF0 to BFF63 in every other three buffer amplifiers and also output the maximum gradation voltage V63 and minimum gradation voltage V0 when the number of pixel bits is reduced. Accordingly, there is no possibility for reduction of contrast even when any color of white and black is used as the background color by providing such outputs of V63 and V0. However, in this case, interval in reduction of voltages is widened a little almost at the intermediate voltage between the maximum gradation voltage V63 and minimum gradation voltage V0.

On the other hand, the gradation voltage selector 35 is composed of selectors 351, 352, 353 for selecting any one of the gradation voltages V63 to V0 from the gradation voltage generator 36 based on the picture data of 6 bits in maximum respectively corresponding to RGB colors. Moreover, in this embodiment, bit converters 391, 392, 393 are provided between the second latch circuit 34 and gradation voltage selector 35 so that the voltage which is no longer generated depending on reduction of gradation voltage to be generated is not selected by replacement of arrangement of the bits of pixel data.

These bit converters 391 to 393 transfer in direct, when one pixel is formed of 6 bits respectively for RGB colors, the data of the latch circuit 34 and convert such data to the data B5, B4, B3, B2, B1, B5 by putting the most significant bit B5 in place of the least significant bit B0 which is invalidated when one pixel is formed of 5 bits (for example, B5, B4, B3, B2, B1) respectively for RGB colors.

Accordingly, an output of the buffer amplifier which outputs the maximum voltage V63 and the minimum voltage V0 and is set to the OFF state can no longer be selected. In this embodiment, interval of reduction of voltage is a little wider than the other intervals at the intermediate voltages between V63 and V0 by outputting the maximum gradation voltage V63 and minimum gradation voltage V0, but it is also possible to configure the bit converter 39 so that that the gradation voltages between V63 and V0 are never reduced and such gradation voltages are selected.

Moreover, in this embodiment, replacement method of bits when one pixel is formed of 5 bits respectively for RGB colors, but when one pixel is formed of 4 bits or 3 bits respectively for RGB colors, it is also possible, based on the similar concept, that the bit replacement is performed for the RGB codes to select voltages in the predetermined interval from the gradation voltages V63 to V0 and to output both maximum gradation voltage V63 and minimum gradation voltage V0.

In addition, it is also possible to provide the configuration to output the gradation voltages to compensate for the γ characteristic of the liquid crystal display panel used by providing a selector to select the resistor-divided voltage with the ladder resistor 361 between the ladder resistor 361 and the buffer amplifiers BFF0 to BFF63, also providing a register for setting the γ characteristic of the liquid crystal display panel into the control register 12 and thereby outputting a voltage of the desired level by switching each selector depending on the setting value of register.

Moreover, in this embodiment, the gradation voltage generator 36 generates the gradation voltages V63 to V0 of the 64 steps but an effective intermediate voltage (V21+V22)/2 can be applied to the liquid crystal and thereby the gradation display of 64 gradations can substantially be realized by generating the gradation voltages V31 to V0 of 32 steps in place of the gradation voltages of 64 steps and by alternately displaying adjacent two voltages (for example, V21 and V22) selected freely, namely V21 to the first frame and V22 to the second frame among two frames in the gradation selector 35 using the generated gradation voltages V31 to V0 of 32 gradation steps.

Figure 10:
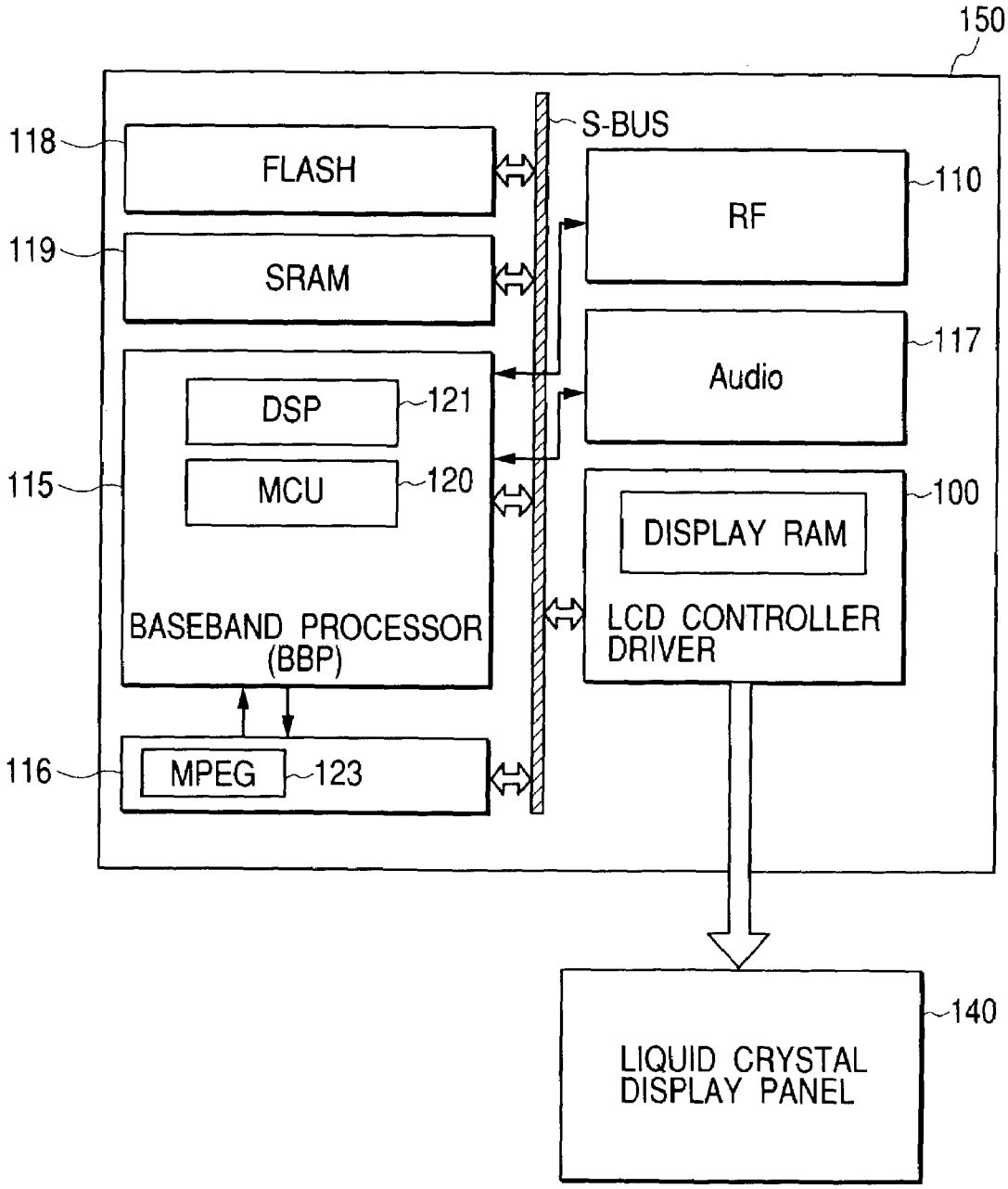
FIG. 10 is a block diagram illustrating a configuration example of a mobile phone system in which the liquid crystal controller driver of the embodiment is employed.

Next, a system utilizing the liquid crystal controller driver of the embodiment described above will be described below. FIG. 10 illustrates an example of circuit configuration of a mobile phone system utilizing the liquid crystal controller driver of the embodiment described above.

In the same figure, numeral 100 designates the liquid crystal controller driver described above; 110, an RF unit for high frequency for transmission and reception of a radio signal and conversion between the radio signal and the baseband signal; 115, a baseband processor as a system controller for signal processes of an audio signal and transmission/reception signal and control of the system as, a whole; 116, an application processor having a multimedia processing function of moving picture process or the like conforming to the MPEG system or the like, a resolution adjustment function and a JAVA high speed processing function or the like; 117, an audio processing unit for outputting a termination sound and performing signal process of receiving audio signal; 118, a non-volatile memory for storing setting data of user such as address data; 119, an SRAM (Static Random Access Memory) used as a frame buffer for storing still picture data of one display picture of the liquid crystal panel or as a buffer memory of display data when the moving picture is reproduced. These circuits are all mounted on a system board 150 consisting of a printed circuit board.

The baseband processor 115 is composed of a DSP (Digital Signal Processor) 121 for extracting audio data by identifying the self-destined receiving data and converting the transmitting data to a format for radio transmission and an MCU (Micro-controller Unit) 120 for performing system control based on manipulation contents of user, data process of transmission and reception data and display control. The application processor 116 is the LSI mounted depending on the performance of the system as a whole and is composed of a decoder circuit 123 for performing a decoding process of the MPEG (Moving Picture Experts Group) data and a JAVA language processing circuit or the like. Here, it is also possible to form the system where this application processor may also be eliminated as required. A numeral 140 designates a color liquid crystal display panel which is driven for display with the liquid crystal controller driver 100. In the system utilizing the liquid crystal controller driver of this embodiment as the liquid crystal controller driver 100, complete picture display can be realized using the liquid crystal display panel 140 of the size where amount of display data of one display picture is larger than the capacity of the internal display RAM 20 of the liquid crystal controller driver.

The liquid crystal controller driver 100, RF unit for high frequency 110, baseband processor 115, application processor 116, memory 118 and SRAM 119 are mutually connected with a system bus S-BUS formed on the board for enabling data transfer. In the liquid crystal controller driver of this embodiment, a picture which changes only a little in the display mode can be displayed, even when the picture data is not read each time from the memory 119 and is not transferred to the liquid crystal controller driver 100 unlike the prior art, by previously writing picture data to the display RAM 20 in the liquid crystal controller driver 100 with the baseband processor 115. As a result, a load of the baseband processor 115 can be alleviated.

Further, this mobile phone system utilizing the liquid crystal controller driver of this embodiment enables fixed display of telephone number and name of the communication party to the liquid crystal display panel 140 and moreover enables display of moving picture with the direct write display by way of no internal display RAM 20 by decoding the moving picture data received with the decoder circuit 123 and storing once this data to the SRAM 119 and thereafter sending the decoded data to the liquid crystal controller driver 100 with the baseband processor 115 in synchronization with the display timing.

Figure 11A:
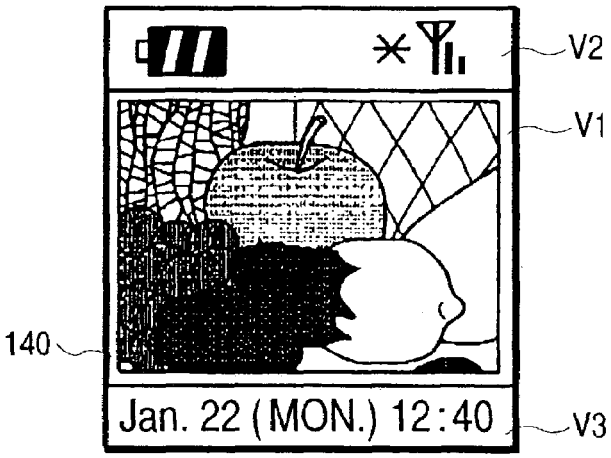
FIGS. 11A and 11B are picture diagrams illustrating display examples in the mobile phone system of FIG. 10.

FIG. 11 illustrates example of display picture to the liquid crystal display panel 140 in the mobile phone system of FIG. 10.

Figure 11B:
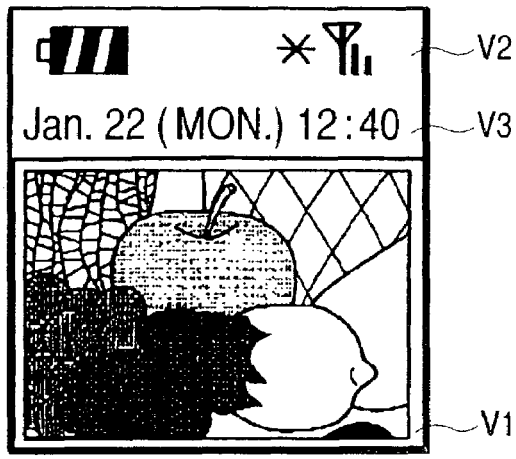

According to the mobile phone system described above, as illustrated in FIG. 11A, display output can be performed with inclusion of display of moving picture V1 based on the direct write display and fixed displays V2, V3 based on display data of the display RAM 20. Moreover, display position of the fixed displays V2 and V3 can also be changed to the desired position as illustrated in FIG. 11B depending on the setting value of the allocation register 13 with the baseband processor 115.

As described above, since the fixed display system based on display data of the display RAM 20 is applied for display including a small amount of changes such as the display of power supply mark, antenna mark and date and time information, while the direct write display system for display including a large amount of changes such as the display of moving pictures, the process to transfer many times the same display data including a small amount of changes to the liquid crystal controller driver can be saved and an alternative route to the display RAM 20 for display data including frequent changes can also be saved. Namely, the processing system can be selected depending on contents of display. Accordingly, power consumption can be reduced with the processes depending on contents of display.

The method for selective display of the data in the internal RAM and for direct display of the external data has been described above. As an application method utilizing this method, a method for transparent display is illustrated in FIG. 12. The transparent display function is capable of displaying or not displaying the designated color on the panel. This transparent display function may be realized with the configuration comprising a register (transparent register 165) for holding color information, a latch circuit (write data latch 11) for holding data externally inputted and a circuit (compare circuit 166) for comparing an output of the register with an output of the latch circuit. Kinds of color displayed on the panel are controlled with an output of the compare circuit 166. The color information is held as the data of several bits respectively for red R, green G and blue B elements.

Figure 12A:
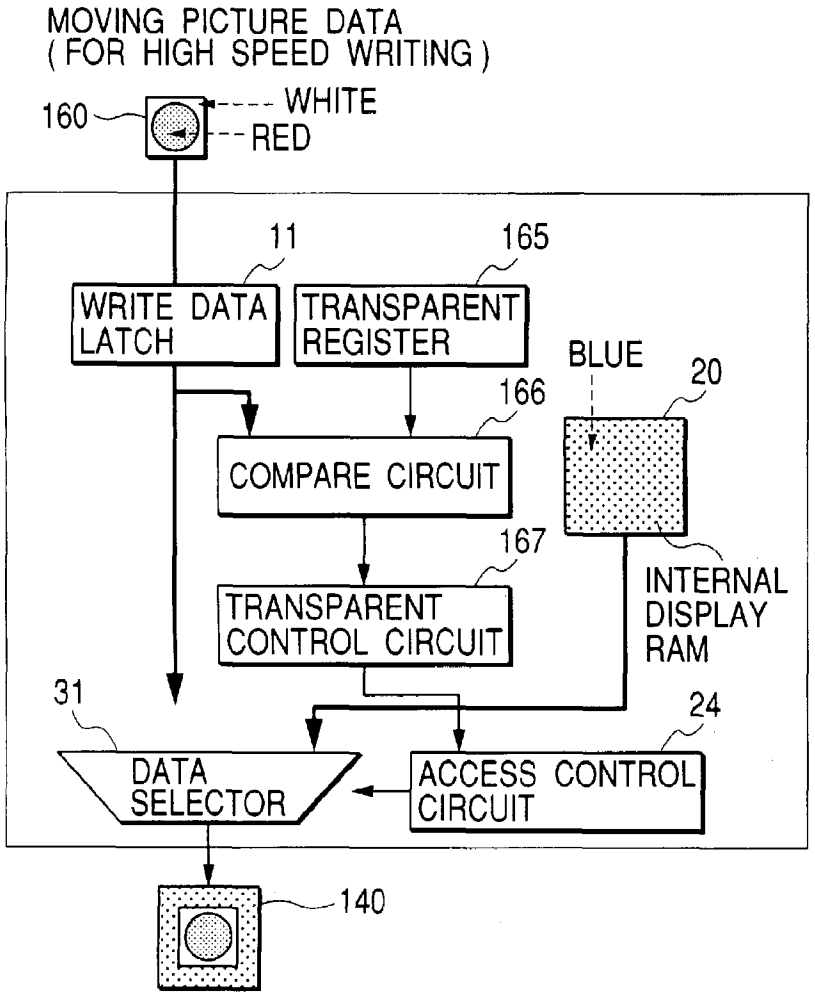
FIGS. 12A to 12B are diagrams for describing the main configuration and its operation example of the liquid crystal controller driver which enables transparent control.

FIG. 12A illustrates the condition of the mode where data of the write data latch 11 is outputted in direct to the data selector 31 by way of no compare circuit 166.

Figure 12B:
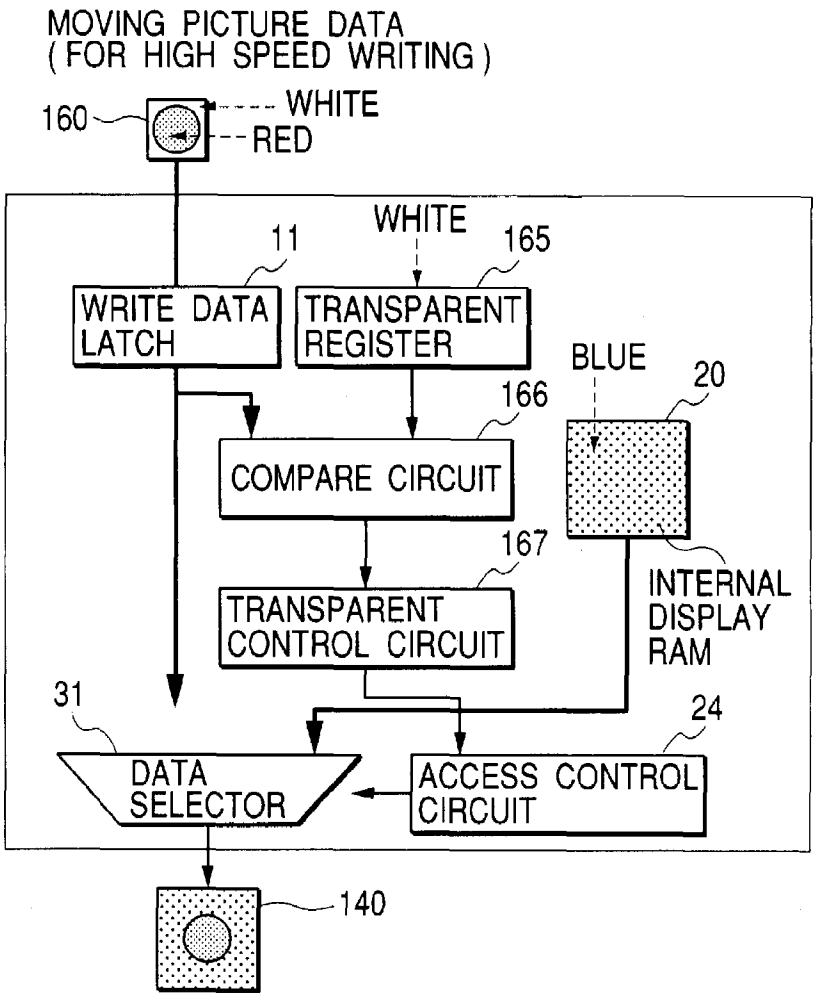

FIG. 12B illustrates the condition of the mode where data of the write data latch 11 is outputted via the compare circuit 166 and therefore the particular color signal is not, outputted from a transparent control circuit 167 through the comparison with the register 165 holding the color information. The operation modes of FIG. 12A and FIG. 12B may be switched with a control applied from an external circuit of the chip or with a value of the color information register.

In FIG. 12A (in the operation mode where the transparent display is not performed), an output of the write data latch 11 is outputted in direct to the data selector 21 by way of no compare circuit 166 and output timing of the data selector 31 displayed on the panel 140 superimposed on the output data of internal RAM 20 is controlled with an access control circuit 24. In FIG. 12B, the desired display color (white) which should not be outputted is set in the transparent register 165. An output of the transparent register 165 and an output of the write data latch 11 are inputted to the compare circuit 166.

Output values inputted are compared with each other in the compare circuit 166 and result of match and mismatch is outputted to the transparent control circuit 167. This transparent control circuit 167 generates also a signal which indicates that the particular color (for example, white) is the transparent color (not outputted) and a result of process is transferred to the access control circuit 24. Output timing of the data selector 31 displayed on the panel 140 is controlled with the access control circuit 24 and is then superimposed on the read data from the internal RAM 20 in the data selector 31. Accordingly, the color information inputted to the register 165 is the transparent data on the panel and the blue data in the background is displayed on the panel. Here, it is also possible to introduce the system for setting the information of color which is not the transparent color to the non-transparent register 165 in place of the transparent register 165 and then outputting only the color matched with the output of the write data latch 11. Here, it is also preferable to introduce the configuration to reduce the number of objects to be compared.

With the method described above, a particular figure (a circle in this case) in the rectangular area is cut and then displayed on the panel 140 as illustrated FIG. 12B.

The present invention has been described practically based on the preferred embodiment thereof but the present invention is never limited only to the embodiment described above and allows of course various changes and modifications within the scope not departing from the claims thereof.

For example, the display RAM (display memory) 20 has been described in the embodiment as a memory to store display data including a small amount of changes such as mark display or date and time display. However, this display memory can be configured to store only the display data (color data) of the part colored with the same color such as the background color for the background display with the data of such display memory and for the display of the other portions with the direct write operation by ways of no display memory.

In addition, the selector 15 has been used as a selecting means to transfer the display data to the display memory from the input interface or to transfer in direct the display data to the output driver side by way of no display memory. However, various changes or modifications are also possible to realize the function as the selecting means described above, for example, by switching of the ON/OFF conditions of the write command of the display RAM 20 and switching operation of the data selector 31. Moreover, it is also possible that two input ports of display data are provided to the input interface and one is connected to the display memory side, while the other is connected to the output memory side by way of no display memory.

The present invention has been described above mainly for liquid crystal controller driver of the mobile phone system which is the application field as the background thereof, but the present invention is never limited thereto and can also be widely used in a display driver control circuit for driving the display panel of a small-size mobile type electronic devices.

The typical inventions of the present invention can provide the following effects.

Namely, according to the present invention, since capacity of display memory can be reduced adequately even when display sizes and the number of colors of display panel increase, chip size and cost can be reduced and moreover power consumption can also be lowered. This effect is particularly important to introduce a small-size mobile type electronic device.

Moreover, for the display processes including the display of data with a small amount of changes and the display of data with frequent changes like the moving picture, two kinds of systems, namely the transfer system of display data via the display memory and the transfer system by way of no display memory can be selectively used depending on contents of display. Accordingly, useless transfer process can be saved and power consumption can also be lowered. In addition, it is also possible to realize the transparent display through the effects described above.

What is claimed is:

1. A display driver control circuit formed on a semiconductor substrate, the display driver control circuit comprising:

an input interface for receiving externally input display data comprising first display data and second display data;

a first selector coupled to the input interface and having a first output and a second output;

a first register coupled to the first selector to control an operation of the first selector so that the first display data is provided to the first output of the first selector and the second display data is provided to the second output of the first selector;

a display memory coupled to the first output of the first selector to store the first display data provided from the first output of the first selector;

a second selector coupled to the second output of the first selector and coupled to an output of the display memory;

a latch circuit coupled an output of the second selector and which stores data corresponding to one horizontal line of a display panel;

an output driver coupled to the latch circuit and which generates and outputs drive signals of gradation voltages based on the first or the second display data;

a second register that stores a setting value for setting a display position on the display panel for the first display data stored in the display memory; and a display position control portion coupled to the second register and controlling operations of both the second selector and the latch circuit in accordance with the setting value of the second register so that the first display data read from the display memory and the second display data provided from the first selector can be simultaneously stored in the latch circuit.

2. The display driver control circuit according to claim 1, wherein the first register and the second register are arranged to be loaded from one or more sources external to the display driver control circuit.

3. The display driver control circuit according to claim 1, wherein the display position control portion comprises:

a display access control circuit that controls the first display data read timing from the display memory in accordance with the setting value of the second register; and a latch address selector coupled to the latch circuit to select an address of the latch circuit to which the first display data is written.

4. The display driver control circuit according to claim 1, wherein the first display data is still picture data and the second display data is moving picture data.

5. The display driver control circuit according to claim 1, wherein a memory capacity of the display memory is less than a size of the display data for one display picture of the display panel.

6. An electronic apparatus comprising:

a display driver control circuit according to claim 1;

a display device driven by the display driver control circuit; and a system control device providing the first display data to be written into the display memory and setting values of the first and the second registers of the display driver control circuit.

7. The electronic apparatus according to claim 6, wherein the system control device comprises:

a baseband processor providing the first display data; and an application processor that providing the second display data.

* * * * *